350-333

SR

XR 3,973,252

1 A 5105 D

United Sta

Mitomo et al.

[11] 3,973,252

[45] Aug. 3, 1976

[54] LINE PROGRESSIVE SCANNING METHOD FOR LIQUID CRYSTAL DISPLAY PANEL

[75] Inventors: Isamu Mitomo, Hachioji; Tetsunori Kaji, Kokubunji, both of Japan

[73] Assignee: Hitachi, Ltd., Japan

[22] Filed: Apr. 22, 1974

[21] Appl. No.: 463,149

[30] Foreign Application Priority Data

Apr. 20, 1973 Japan ..... 48-44158

[52] U.S. Cl. ..... 340/324 M; 315/169 TV; 350/160 LC

[51] Int. Cl.[2] ..... G09F 9/32

[58] Field of Search ..... 340/324 M, 324 R, 166 EL, 340/168 S; 350/160 LC; 315/169 R, 169 TV

[56] References Cited

UNITED STATES PATENTS 3,432,846 3/1969 Jones et al. ..... 340/324 R

OTHER PUBLICATIONS

*Two-Frequency, Compensated Threshold Multiplexing of Liquid Crystal Displays*, by Alt et al; IBM Tech. Discl. Bull. vol. 16, No. 5; 10/73; pp. 1578–1581.

*Primary Examiner*—Marshall M. Curtis
*Attorney, Agent, or Firm*—Craig & Antonelli

[57] ABSTRACT

In a method of driving a display panel including liquid crystal cells arranged in the form of a matrix and displaying such display information as pictures, characters and numerals, which applies scanning pulse voltages to lateral electrodes of the display panel and applies to longitudinal electrodes of the display panel voltages of the pulse width modulation corresponding to the information to-be-displayed, thus to perform the line progressive scanning, a driving method in which voltages in an address period and in a nonaddress period as applied to the longitudinal electrodes are symmetric in magnitude to a voltage in the nonaddress period as applied to the lateral electrodes, and the difference between voltages in the address period and in the nonaddress period as applied to the lateral electrodes is at least double the difference between the voltages in the address period and in the nonaddress period as applied to the longitudinal electrodes.

6 Claims, 27 Drawing Figures

| | | | X LINE | | |
|---|---|---|---|---|---|
| | | | ADDRESS LINE | NON-ADDRESS LINE | |
| | | | $V_{X1} = V_0$ | $V_{X2} = -\frac{1}{6}V_0$ | $V_{X3} = -\frac{1}{6}V_0$ |
| Y LINE | ADDRESS LINE | $V_{Y1} = -\frac{1}{2}V_0$ | $\frac{3}{2}V_0$ | $\frac{1}{3}V_0$ | $\frac{1}{3}V_0$ |
| | NON-ADDRESS LINE | $V_{Y2} = \frac{1}{6}V_0$ | $\frac{5}{6}V_0$ | $-\frac{1}{3}V_0$ | $-\frac{1}{3}V_0$ |
| | | $V_{Y3} = \frac{1}{6}V_0$ | $\frac{5}{6}V_0$ | $-\frac{1}{3}V_0$ | $-\frac{1}{3}V_0$ |

3973252
OR-IN 340/324M

FIG. 4 PRIOR ART

| | | | X LINE | | |
|---|---|---|---|---|---|
| | | | ADDRESS LINE | NON-ADDRESS LINE | |
| | | | $V_{X1}=\frac{1}{3}V_0$ | $V_{X2}=0$ | $V_{X3}=0$ |
| Y LINE | ADDRESS LINE | $V_{Y1}=-\frac{1}{3}V_0$ | $\frac{2}{3}V_0$ | $\frac{1}{3}V_0$ | $\frac{1}{3}V_0$ |
| | NON-ADDRESS LINE | $V_{Y2}=0$ | $\frac{1}{3}V_0$ | 0 | 0 |
| | | $V_{Y3}=0$ | $\frac{1}{3}V_0$ | 0 | 0 |

FIG. 5 PRIOR ART

| | | | X LINE | | |
|---|---|---|---|---|---|
| | | | ADDRESS LINE | NON-ADDRESS LINE | |
| | | | $V_{X1}=\frac{2}{3}V_0$ | $V_{X2}=0$ | $V_{X3}=0$ |
| Y LINE | ADDRESS LINE | $V_{Y1}=-\frac{1}{3}V_0$ | $V_0$ | $\frac{1}{3}V_0$ | $\frac{1}{3}V_0$ |
| | NON-ADDRESS LINE | $V_{Y2}=0$ | $\frac{2}{3}V_0$ | 0 | 0 |
| | | $V_{Y3}=0$ | $\frac{2}{3}V_0$ | 0 | 0 |

FIG. 6 PRIOR ART

| | | | X LINE | | |
|---|---|---|---|---|---|
| | | | ADDRESS LINE | NON-ADDRESS LINE | |
| | | | $V_{X1} = \frac{1}{2} V_o$ | $V_{X2} = -\frac{1}{6} V_o$ | $V_{X3} = -\frac{1}{6} V_o$ |
| Y LINE | ADDRESS LINE | $V_{Y1} = -\frac{1}{2} V_o$ | $V_o$ | $\frac{1}{3} V_o$ | $\frac{1}{3} V_o$ |
| | NON-ADDRESS LINE | $V_{Y2} = \frac{1}{6} V_o$ | $\frac{1}{3} V_o$ | $-\frac{1}{3} V_o$ | $-\frac{1}{3} V_o$ |
| | | $V_{Y3} = \frac{1}{6} V_o$ | $\frac{1}{3} V_o$ | $-\frac{1}{3} V_o$ | $-\frac{1}{3} V_o$ |

FIG. 7

| | | | X LINE | | |
|---|---|---|---|---|---|
| | | | ADDRESS LINE | NON-ADDRESS LINE | |
| | | | $V_{X1} = V_o$ | $V_{X2} = -\frac{1}{6} V_o$ | $V_{X3} = -\frac{1}{6} V_o$ |
| Y LINE | ADDRESS LINE | $V_{Y1} = -\frac{1}{2} V_o$ | $\frac{3}{2} V_o$ | $\frac{1}{3} V_o$ | $\frac{1}{3} V_o$ |
| | NON-ADDRESS LINE | $V_{Y2} = \frac{1}{6} V_o$ | $\frac{5}{6} V_o$ | $-\frac{1}{3} V_o$ | $-\frac{1}{3} V_o$ |
| | | $V_{Y3} = \frac{1}{6} V_o$ | $\frac{5}{6} V_o$ | $-\frac{1}{3} V_o$ | $-\frac{1}{3} V_o$ |

FIG. 26

| | | | X-LINE | | |
|---|---|---|---|---|---|
| | | | ADDRESS LINE | NON-ADDRESS LINE | |
| | | | 22.5 | 0 | 0 |
| Y LINE | ADDRESS LINE | -5.5 | 28.0 | 5.5 | 5.5 |
| | NON-ADDRESS LINE | +5.5 | 17.0 | -5.5 | -5.5 |
| | | +5.5 | 17.0 | -5.5 | -5.5 |

LINE PROGRESSIVE SCANNING METHOD FOR LIQUID CRYSTAL DISPLAY PANEL

BACKGROUND OF THE INVENTION

1. Field of the Invention

The present invention relates to a method of driving a display panel composed of a first group of electrodes which are arranged in parallel to one another, a second group of electrodes which cross the first group of electrodes and which are arranged in parallel to one another, and display cells which are respectively connected at the intersection points between the first and second groups of electrodes and each of which has optical characteristics being substantially symmetric for input electric quantities of positive and negative polarities.

2. Description of the Prior Art

Where the panel is driven by the line progressive scanning, electric quantities applied to the display cells during a period of the half address state caused by nonaddress lines among the first group of electrodes (hereinafter termed X-lines) and address lines among the second group of electrodes (hereinbelow called Y-lines) and during a period of the nonaddress state caused by nonaddress lines among the X-lines and nonaddress lines among the Y-lines are respectively different in the absolute value. Besides, the rate at which the half address state and the nonaddress state arises varies in dependence on information to-be-displayed. For this reason, there is the disadvantage that the quality of display information differs in dependence on input information as will be described in detail later. A further disadvantage is that the electric quantities to be applied to addressed display cells are restricted to small values.

SUMMARY OF THE INVENTION

An object of the present invention is to provide a line progressive scanning method capable of displaying pictures, numerals, etc., of good quality.

Another object of the present invention is to provide a line progressive scanning method capable of displaying pictures, numerals, etc., of good contrast.

In order to accomplish such objects, the present invention carries out the line progressive scanning by applying asymmetric voltages to address lines in the X- and Y-directions and by applying voltages of equal absolute value to nonaddress lines of the X-lines.

Hereunder the present invention will be explained in comparison with the prior art with reference to the accompanying drawings.

BRIEF DESCRIPTION OF THE DRAWINGS

FIGS. 4, 5, and 6 are explanatory diagrams of prior art drive systems;

FIGS. 7 and 8 are explanatory diagrams of a drive system of the present invention;

FIG. 8 is a waveform diagram which shows an example of waveform by a prior art drive method;

DESCRIPTION OF THE PREFERRED EMBODIMENTS

Figure 1A:
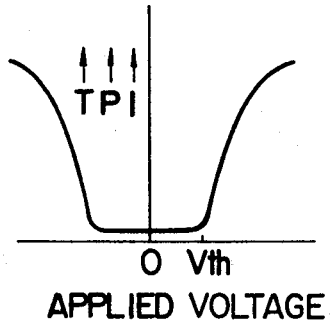
FIG. 1a PRIOR ART
FIGS. 1*a* and 1*b* are explanatory diagrams which illustrate an example of characteristics of a display cell of the type to which the present invention is directed.
Figure 1B:
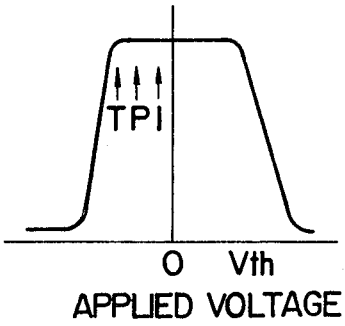
FIG. 1b PRIOR ART

As illustrated by way of example in FIG. 1*a* and FIG. 1*b*, a display cell for use in the present invention has optical characteristics, such as transmission factor T, reflection factor P and luminous intensity I, which are substantially symmetric for positive and negative input electric quantities. As display cells having such characteristics, there are liquid crystal cells, electroluminescent cells, cells in which a ferroelectric substance or a nonlinear resistance is added to the liquid crystal or electroluminescent materials, and so forth. In order to simplify the explanation, the case of a liquid crystal will be referred to. While the input electric quantities include voltages, currents, charges, etc., the following description will be made of only the case of voltages. The symmesry of the display cell need not be especially strict, but it is meant that display cells having clear asymmetry, such as found in the diode characteristic are excluded.

Figure 2:
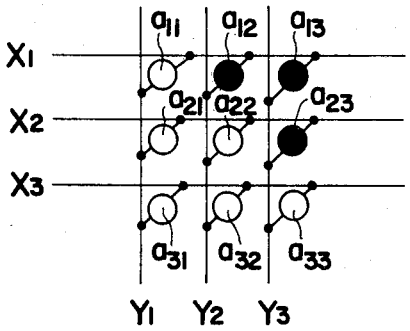
FIG. 2 PRIOR ART
FIG. 2 is a connection diagram which shows an example of a panel of the type to which the present invention is applied.

Shown in FIG. 2 is an example of the equivalent circuit of a panel of the type to which the present invention is applied. The figure illustrates the case of a 3 × 3 arrangement of picture elements. The number of picture elements may be two or larger, and the illustrated case is cited in order to facilitate the description.

Figure 3:
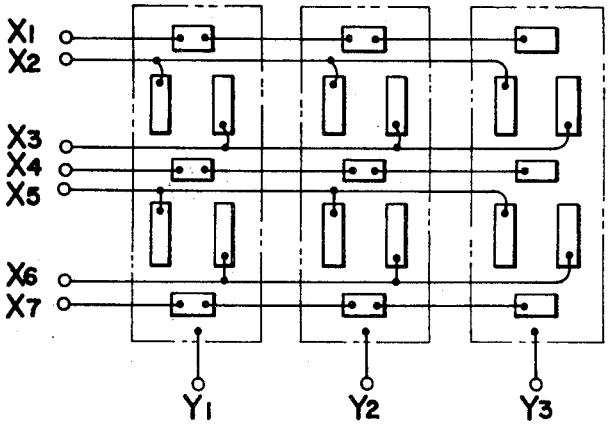
FIG. 3 PRIOR ART
FIG. 3 is a connection diagram which shows an example of a segment type display panel.

In the figure display cells arranged in the form of a matrix as an example are connected at one end to a first group of electrodes $X_1$, $X_2$ and $X_3$ at every row, and are connected at the other end to a second group of electrodes $Y_1$, $Y_2$ and $Y_3$ at every column. The panel to which the present invention is applied may be any panel insofar as its equivalent circuit has the form of FIG. 2. Of course, the invention is applicable to a segment type display panel of the type shown in FIG. 3.

Examples of voltages $V_{X1}$, $V_{X2}$ and $V_{X3}$, and voltages $V_{Y1}$, $V_{Y2}$ and $V_{Y3}$ to be applied in the prior art to the respective electrodes $X_1$, $X_2$ and $X_3$ and $Y_1$, $Y_2$ and $Y_3$ of the panel of this sort are shown in FIGS. 4 to 6. These figures illustrate a case where only the display cell $a_{11}$ in FIG. 2 is addressed.

The prior art method of applying the voltages as illustrated in FIG. 4 is the most fundamental. With this method, a voltage impressed on a nonaddress display cell is 0 or ⅓ $V_0$. On the other hand, a voltage impressed on the address display cell $a_{11}$ in FIG. 2 is double the maximum value of the voltage impressed on the nonaddress display cell. That is, when the value ⅓ $V_0$ is taken as the threshold voltage (hereinbelow denoted by $V_{th}$) of the display cell, the voltage applied to the address display cell $a_{11}$ becomes $2V_{th}$.

In case of driving the panel as shown in FIG. 2, however, the drive need be in the time division. In that case, the period of time during which the address display cell is selected is naturally short. Therefore, the value $2V_{th}$ is often insufficient for the voltage applied to the address display cell (particularly in case where the number of display cells is large). For this reason, the prior art has the disadvantage that a satisfactory contrast is not achieved.

Figure 9:
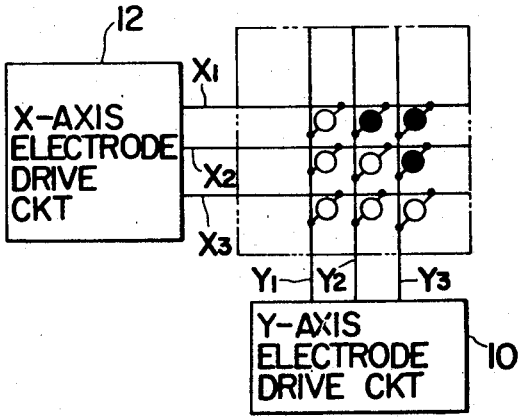
FIG. 9 is an explanatory diagram which illustrates states in which two levels of a picture are displayed.

As a method which displays information at high speed by the use of the panel in FIG. 2, the line progressive scanning method has been known. As illustrated in FIG. 9, this method applies a scanning voltage to the first group of electrodes $X_1$, $X_2$ and $X_3$ from an X-axis electrode drive circuit 12, and simultaneously applies a voltage of a picture information for display to a second group of electrodes $Y_1$, $Y_2$ and $Y_3$ from a Y-axis electrode drive circuit 10.

The following description is fully devoted to the case of the line progressive scanning method.

Figure 8:
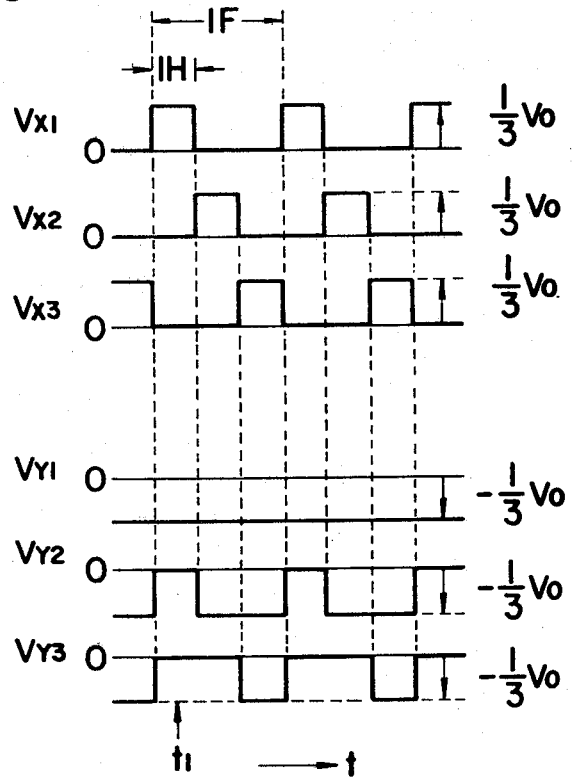

A waveform in the case where the line progressive scanning is performed by the driving method of FIG. 4 is shown in FIG. 8. The picture to be displayed at this time is such that, as shown in FIG. 9, the display cells $a_{11}$, $a_{21}$, $a_{22}$, $a_{31}$, $a_{32}$, $a_{33}$ are "on" while those $a_{12}$, $a_{13}$ and $a_{23}$ (indicated in black in the figure) are "off". The voltage in FIG. 4 corresponds to that at $t = t_1$ in FIG. 8.

In case of performing such line progressive scanning, a period in which the half address (parts surrounded by broken lines in FIG. 4) by a nonaddress line among the X-lines and address lines among the Y-lines and the nonaddress (a part surrounded by a one-dot chain line in FIG. 4) by the nonaddress line among the X-lines and a nonaddress line among the Y-lines arise differs in dependence on the picture to-be-displayed. It is 1 F (F: frame) — 1 H (H: horizontal scanning period) within 1 F at the maximum. Where 1 F is composed of a large number of periods H, for example, 100 H, the value (1 F − 1 H) is approximately equal to 1 F.

On the other hand, a period in which the half address (parts surrounded by solid lines in FIG. 4) by address lines among the X-lines and the nonaddress line among the Y-lines arises is only 1 H within 1 F. Where 1 F is composed of a large number of periods H (for example, 100 H), the rate at which this half address occurs is very small.

In consequence, the degradation of the display picture due to the half address by the address lines among the X-lines and the nonaddress line among the Y-lines is less than the degradation of the picture due to the half address or nonaddress by the nonaddress line among the X-lines and the address lines or nonaddress line among the Y-lines. It is therefore possible that the voltage to be applied to the X-lines is made greater than the voltage to be applied to the Y-lines, in other words, that the voltages are made asymmetric.

In consideration of this fact, the prior art hn FIG. 5 has improved the system in FIG. 4. In this case, the voltage applied to the address display cell is greater than in the case of FIG. 4, and a better contrast can be expected.

According to the voltage applying methods in FIG. 4 and FIG. 5, however, the absolute values of the voltages applied to the display cells during the period of the half address by the nonaddress line among the X-lines and the address line among the Y-lines and during the period of the nonaddress by the nonaddress line among the X-lines and the nonaddress line among the Y-lines are respectively different.

As previously stated, the rate at which the half address and the nonaddress occur changes in dependence on the picture information to-be-displayed. For this reason, in the first place, there is the disadvantage that the quality of the display picture changes in dependence on input information. The second disadvantage is that, even when the asymmetric applied voltages illustrated in FIG. 5 are used, the voltage impressed on the address display cell is still restricted to a small value.

As a method for obviating the disadvantages, the method in FIG. 6 has heretofore been proposed. By appropriate selection of voltages to be applied to the X-lines and the Y-lines, the absolute values of the voltages of all the nonaddress display cells can be made equal, and the voltage of the address display cell can be made at most three times as great as the voltage of the nonaddress display cell.

Thus, in comparison with the case of FIG. 4, the change of the quality of the display picture depending on the change of the input picture is eliminated, and the voltage impressed on the address display cell increases. Even the method in FIG. 6, however, has the disadvantage that the voltage applied to the address display cell is still restricted to a small value.

The present invention provides a new driving system which enjoys both the increase of the address voltage owing to the application of the asymmetric voltages as illustrated in FIG. 5 and the uniformalization of the absolute values of the voltages applied to the display cells connected to the nonaddress line among the X-lines as illustrated in FIG. 6, and makes the picture display of good quality possible.

An embodiment of the driving system of the present invention is illustrated in FIG. 7 in comparison with the prior art which has thus far been described. In this case, unlike the case of FIG. 6, the amplitude of a pulse to be impressed on the X-lines is made larger than the amplitude of a pulse to be impressed on the Y-lines. Using this system, the change of the picture quality dependent upon the input picture information is eliminated, and besides, the voltage impressed on the address display cell is great, so that the picture display of good contrast is made possible for the first time.

Figure 10:
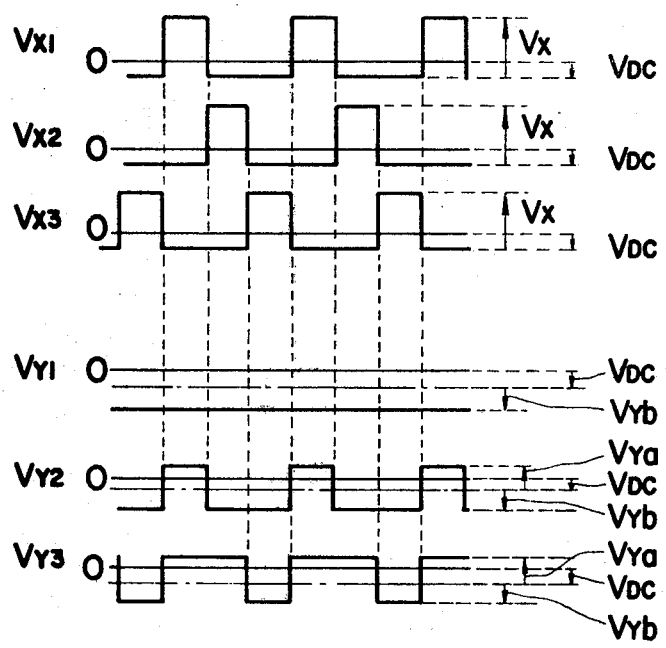
FIGS. 10, 13, 14, 15, 19, 20, and 21 are waveform diagrams which show examples of drive waveforms by the present invention.

An example of various waveform in the system of the present invention in the case of performing the line progressive scanning is shown in FIG. 10. The figure corresponds to the case where the display cells $a_{11}$, $a_{21}$, $a_{22}$, $a_{31}$, $a_{32}$ and $a_{33}$ are "on" while those $a_{12}$, $a_{13}$ and $a_{23}$ are "off". The D.C. bias voltage $V_{DC}$ can take an arbitrary value. The absolute values of voltages $V_{Ya}$ and $V_{Yb}$ in the figure should preferably be approximately equal, and actual measurements have revealed that they are substantially satisfactory if they meet the conditions of the following equations:

$$\frac{\left| |V_{Ya}| - \left| \frac{V_{Ya} - V_{Yb}}{2} \right| \right|}{\left| \frac{V_{Ya} - V_{Yb}}{2} \right|} \leq 0.1 \qquad (1)$$

$$\frac{\left| |V_{Yb}| - \left| \frac{V_{Ya} - V_{Yb}}{2} \right| \right|}{\left| \frac{V_{Ya} - V_{Yb}}{2} \right|} \leq 0.1 \qquad (2)$$

Regarding a voltage to be impressed on the X-lines, it has been revealed by actual measurements that a range fulfilling the following equation is preferable:

$$\frac{|V_X|}{|V_{Ya} - V_{Yb}|} > 2 \qquad (3)$$

(In the prior art in FIG. 6, the value of Equation (3) becomes 1.)

A case where the present invention stated above is applied to a liquid crystal panel will now be explained in comparison with the case of the prior art.

Panel employed: 10 × 50 picture elements

Display contents:

alphabetic letters and numerals number of characters: 7

Operating mode of liquid crystal employed: dynamic scattering mode

| Prior Art Drive Method (FIG. 6) |
|---|
| Contrast 5 : 1 |
| (voltage applied to address point = 18 volts) |
| Drive Method of Present Invention |
| Contrast 12 : 1 |

($V_X = 22.5$ volts, $V_{Ya} = V_{Yb} = 5.5$ volts, voltage applied to address point = 28 volts)

The above-mentioned values are those at the time when the identical panel was used and was set at the best states for the respective methods. FIG. 26 illustrates an embodiment of the driving system of the present invention utilized to obtain the voltage of 28 volts at the address point.

Figure 16:
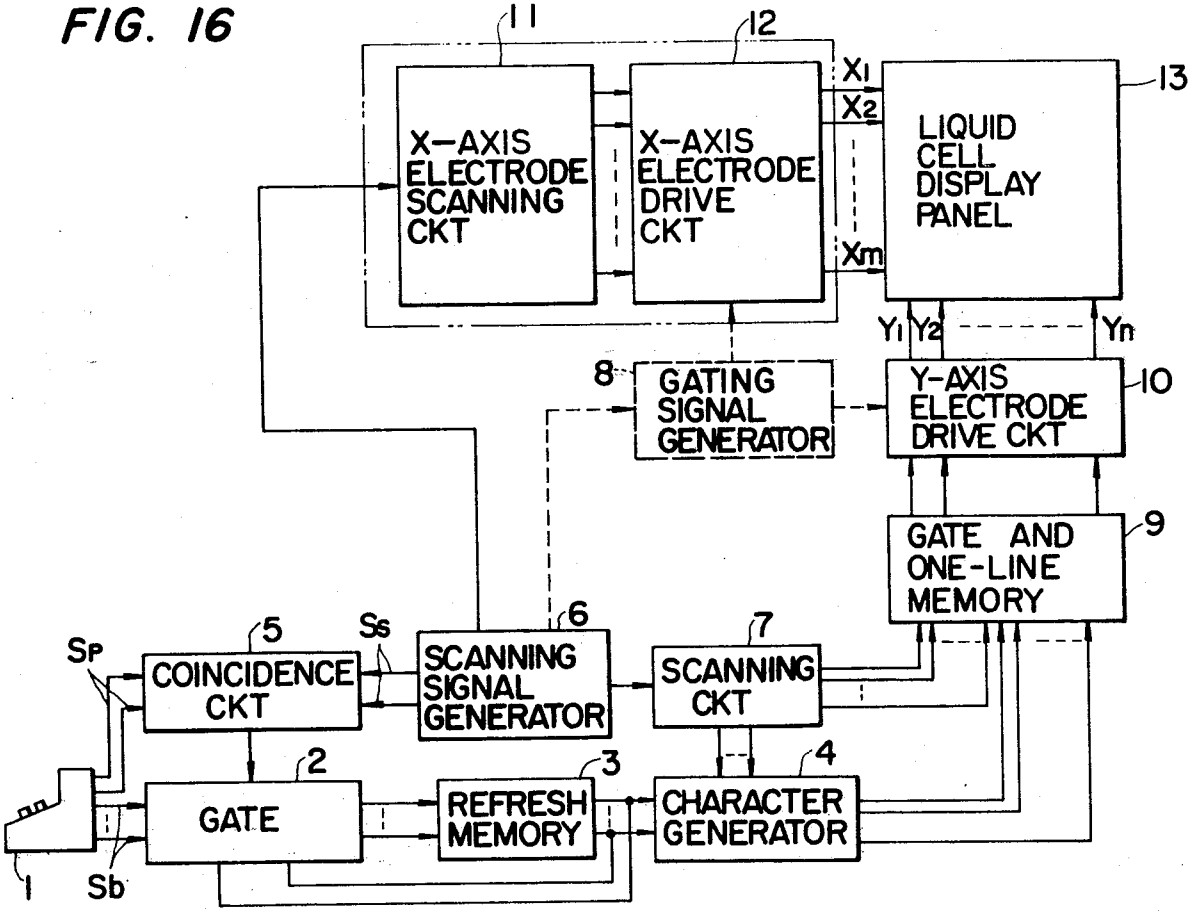
FIG. 16 is a block diagram which shows the construction of a character display device.

An embodiment of a liquid crystal display panel-driving device for performing the drive system according to the present invention is shown as a block diagram in FIG. 16. The figure shows a case of displaying characters.

Referring to the figure, a coded character signal $S_b$ and a coded display position signal $S_p$ of a character are transmitted from a keyboard 1. On the other side, a scanning position signal $S_s$ is transmitted from a scanning signal generator 6 repeatedly at all times. When the coded display position signal $S_p$ and the scanning position signal $S_s$ become coincident, a pulse is transmitted from a coincidence circuit 5 and is impressed on a gate 2.

In the absence of the pulse from the coincidence circuit 5, the gate 2 supplies the output of a refresh memory 3 as the input of the same without any change, to repeatedly supply the previously applied character signal to a character generator 4. In contrast, where the pulse from the coincidence circuit 5 is applied, the gate 2 inputs the character signal $S_b$ of the keyboard 1 to the refresh memory 3.

A scanning circuit 7 supplies a scanning pulse to the character generator 4 and a gate and one-line memory 9 by the output signal of the signal generator 6. By the coded character signal transmitted from the refresh memory 3 acting as a delay circuit and the scanning signal transmitted from the scanning circuit 7, the character generator 4 inputs to the gate and one-line memory 9 a signal which corresponds to the shape of the actual character. That is, the input applied to the character generator 4 is a coded signal of, for example, 6 bits or 8 bits, which is converted into a signal representative of the actual character in the character generator 4.

In the gate and one-line memory 9, the signals representative of the actual characters which correspond to one line are held by the outputs of the scanning circuit 7 and the character generator 4 for a period of 1 H or a period close to 1 H. The output of the gate and one-line memory 9 and the output of a gating signal generator 8 are applied to a Y-axis electrode drive circuit 10, in which signals to be supplied to Y-axis electrodes are prepared. They are applied to the Y-axis electrodes $Y_1 - Y_{11}$ of a liquid crystal display panel 13.

On the other hand, an X-axis electrode scanning circuit 11 is actuated by the signal from the scanning signal generator 6, and its output and the output of the gating signal generator 8 are inputted to an X-axis electrode drive circuit 12. Here signals to be supplied to X-axis electrodes are prepared, and they are applied to the X-axis electrodes $X_1$ - $X_m$ of the liquid crystal display panel 13. As will be described later, the gating signal generator 8 sets a polarity inversion period for an output voltage as is necessary in case of applying the A.C. drive to the present invention.

Figure 11:
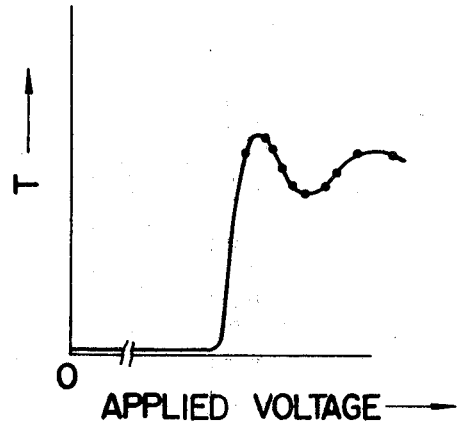
FIG. 11 is a curve diagram which illustrates the color display characteristic of a liquid crystal.

It is known that the color display is made possible by operating the liquid crystal panel in the field effect mode. The color change of the liquid crystal depends substantially on the effective value of the applied voltage of each liquid crystal cell. An example of the color changes of transmitted light relative to the applied voltages in this case is shown in FIG. 11. In the figure, the abscissa represents the applied voltage (in the effective value) and the ordinate the transmission factor T. As shown in FIG. 11, the color changes in the order of white, whitish green, whitish yellow, orange, purple, royal purple, bluish green, green and yellow as indicated by black circles according to the magnitudes of the applied voltages.

Here, consider a case of character display where the background and a character portion are displayed by different colors. In order to prevent the color of the background from changing even when the information of the character to be displayed changes, it is necessary to employ the prior art method in FIG. 6 or the method of the present invention. In the case of FIG. 6, however, the difference between the effective value of the applied voltage of the character portion and the effective value of the applied voltage of the background portion cannot be set to be sufficiently large. On the other hand, with the present invention, the difference can be made large, and accordingly, the range of colors which can be selected widens.

In the present invention, the effective values $E_1$ and $E_2$ of voltages applied to the character portion and the background portion are as follows:

$$E_1 \alpha \sqrt{V_{Ya}^2 \cdot \frac{N-1}{N} + (V_X + Y_{Ya})^2 \cdot \frac{1}{N}} \qquad (4)$$

$$E_2 \alpha \sqrt{V_{Ya}^2 \cdot \frac{N-1}{N} + (V_X - V_{Ya})^2 \cdot \frac{1}{N}} \qquad (5)$$

where $V_{Ya} = - V_{Yb}$, and $N$ denotes the number of the X-lines.

The ratio between $E_1$ and $E_2$ becomes as follows:

$$\frac{E_1}{E_2} \approx \sqrt{1 + \frac{4 V_X}{N V_{Ya}}} \quad (6)$$

where N >>1. –

Here, if $V_X = 2 V_{Ya}$, such case falls into the prior art illustrated in FIG. 6. That is, the ratio of the effective values $E_1/E_2$, obtained by the prior art is restricted as follows:

$$\frac{E_1}{E_2} \approx \sqrt{1 + \frac{8}{N}} \quad (7)$$

On the contrary, in the case of the present invention, $V_X$ can be arbitrarily made large in comparison with $V_{Ya}$, so that the ratio $E_1/E_2$ is not restricted. Therefore, the range of the colors which can be selected expands.

Study will now be made of the construction of a device which readily provides the drive waveform as shown in FIG. 10. Consider the case where the potential of the ground line of the whole device (the first reference potential) is held at $(V_{Ya} + V_{DC})$ or around $(V_{Yb} + V_{DC})$. In this case, the Y-axis electrode drive circuit 10 may effect the switching between the ground line level and another level, and can be made of a simple circuit arrangement (for example, a grounded-emitter circuit is constructed of one transistor and one resistor).

On the other hand, the X-axis electrode drive circuit 12 switches the potential of the ground line of the whole device (the first reference potential) and two different levels. A ground line in a portion enclosed with one-dot chain line in FIG. 16, i.e., in the X-axis electrode scanning circuit 11 and the X-axis electrode driving circuit 12, has its potential (the second reference potential) made one with a bias D.C.-wise added to the potential of the ground line of the whole device. Then, the X-axis electrode drive circuit 12 may effect the switching between the ground line level (the second reference potential) and one different level likewise to the foregoing Y-axis electrode drive circuit 10, and can be made of a simple circuit arrangement (of, for example, one transistor and one resistor).

Figure 17:
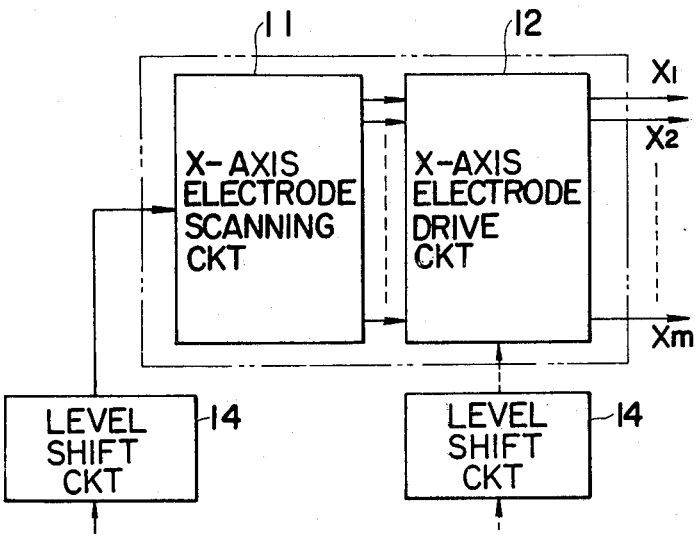
FIGS. 17 and 18 are a block diagram and a circuit diagram, respectively, which illustrate the constructions of various parts of the character display device.
Figure 18A:
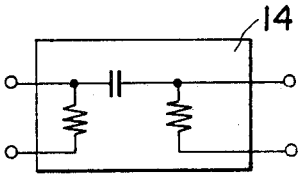
Figure 18B:
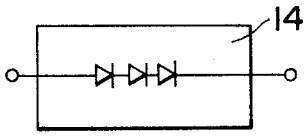

In this case, however, a signal to be inputted to the X-axis electrode scanning circuit 11 and the X-axis electrode driving circuit 12 from another circuit need be passed through a level shift circuit 14, in FIG. 17, for executing the level shift. The level shift circuit 14 can be constructed of a capacitor and a resistor as shown in FIG. 18, or of a diode, etc. Alternatively, it can be substituted by an amplifier. The amount of the level shift has the optimum value determined by a signal waveform to-be-inputted, etc., and the optimum value is close to $|V_{Ya}|$ or $|V_{Yb}|$.

Here the signals which are inputted from another circuit to the circuits 11 and 12 surrounded by the one-dot chain line in FIG. 16 are several sorts of clock signal, reset signal, etc. They are of a small number, and are digital signals repeated at fixed periods (they do not change in dependence on input picture information). For this reason, the number of the required level shift circuits 14 is small, and their construction is simple. By thus subjecting to the level shift the signals which are inputted to the X-axis electrode scanning circuit 11 and the X-axis electrode driving circuit 12 from another circuit, it becomes possible to simply obtain the waveform of the present invention.

Although the above description has been made of the display of two states, such as "bright" and "dark", the system of the present invention can be used for the display of three or more states (the half tone display, multicolor display, etc.). As one means therefor, the pulse width modulation is conducted. As stated previously, the absolute value of the voltage at the half address (the broken-line part in FIG. 7) by the nonaddress line among the X-lines and the address line among the Y-lines and the absolute value of the voltage at the nonaddress (the one-dot chain line part in FIG. 7) are substantially equal. Consequently, even when the pulse width modulation is carried out, the quality of the display picture does not change in dependence on the change of input picture information, and a good display is possible.

Figure 12:
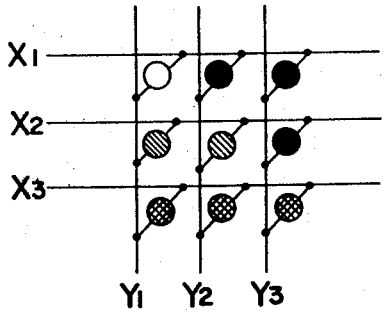
FIG. 12 is an explanatory diagram which shows a display picture at various levels.
Figure 13:
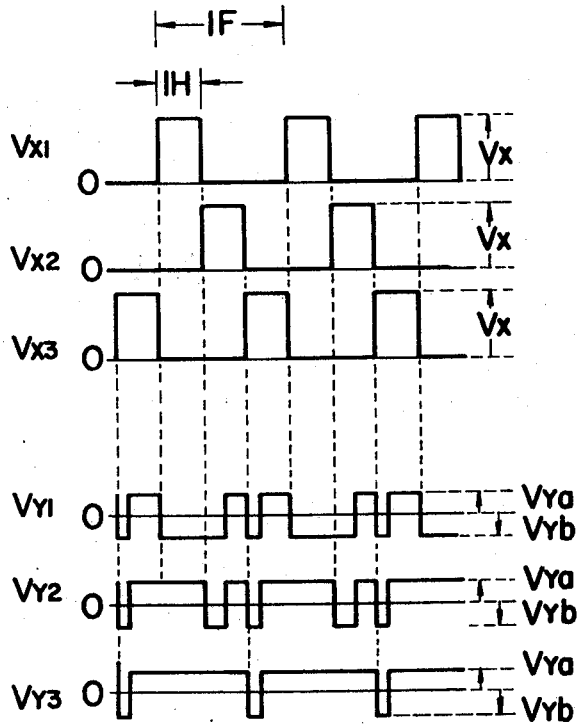

FIG. 13 shows an example of various waveforms according to the present invention as is used in case of displaying a pattern shown in FIG. 12 or a picture in which, among the display cells, $a_{11}$ is the brightest, $a_{21}$ and $a_{22}$ are the second in brightness, $a_{31}$, $a_{32}$ and $a_{33}$ are the third in brightness and $a_{12}$ and $a_{13}$ are the darkest. $V_X$, $V_{Ya}$ and $V_{Yb}$ in the figure satisfy the respective equations (1), (2) and (3).

Figure 14:
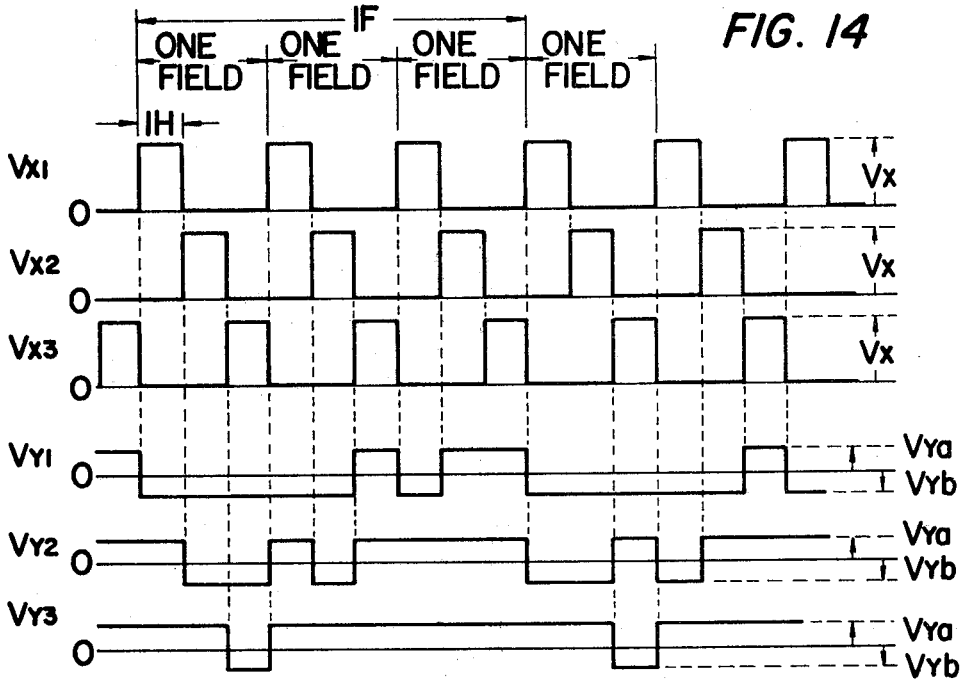
Figure 15:
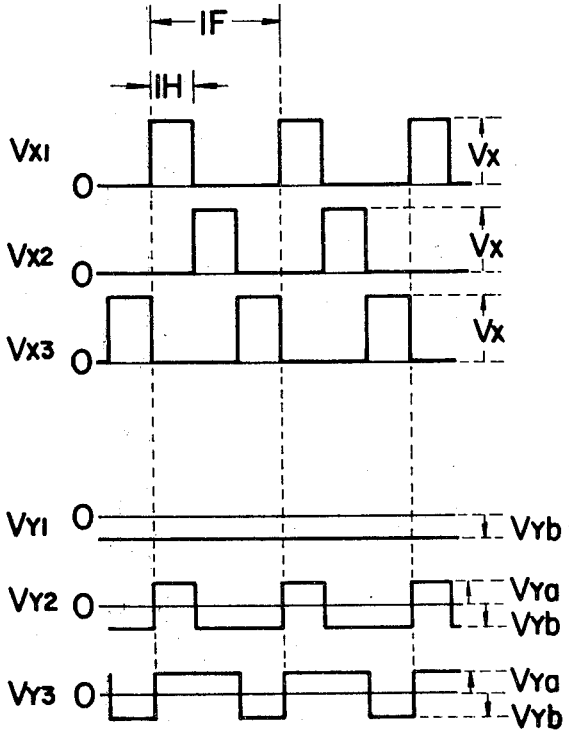

FIG. 14 shows another example of various waveforms for use in the display of many states according to the present invention. The waveform in the figure is of the case of displaying the pattern in FIG. 12. In FIG. 14, 1 F is composed of three fields, and the brightest display cell is addressed at every field, in other words, three times within 1 F.

On the other hand, the display cells of the second and third brightnesses are addressed twice and once within 1 F, respectively. In this manner, a number of states can be displayed by constructing 1 F of a plurality of fields and changing the number of times of the addressing. $V_X$, $V_{Ya}$ and $V_{Yb}$ fulfill the respective equations (1), (2) and (3).

As the method of displaying a number of states of three or more levels, the two systems have been explained above. A system with the two systems combined is, of course, possible. Similarly to the two systems, such combined system, of course, has the features of the present invention that the voltage applied to the address display cell is great and that the change of the picture quality dependent upon the change of input picture information does not occur.

When the waveform with the D.C. bias voltage added as in FIG. 10 is used, the D.C. component is applied to the display cells and changes in dependence on the contents of a picture to-be-displayed. The presence of the D.C. component sometimes exerts a bad influence on the operation of the panel. For example, the liquid crystal panel is subjected to such influence, which will be described later.

Even where the expected operation is not achieved due to the presence of the D.C. component, the present invention becomes applicable by the use of the following method. In order to remove the D.C. component, the polarity of the voltage applied to the display cell may be inverted at every fixed period (this operation will be hereinafter termed the A.C. drive). By bringing the waveform shown in FIG. 10 into the A.C. drive, great strides of improvements in characteristics are also possible as will be stated later.

Figure 19:
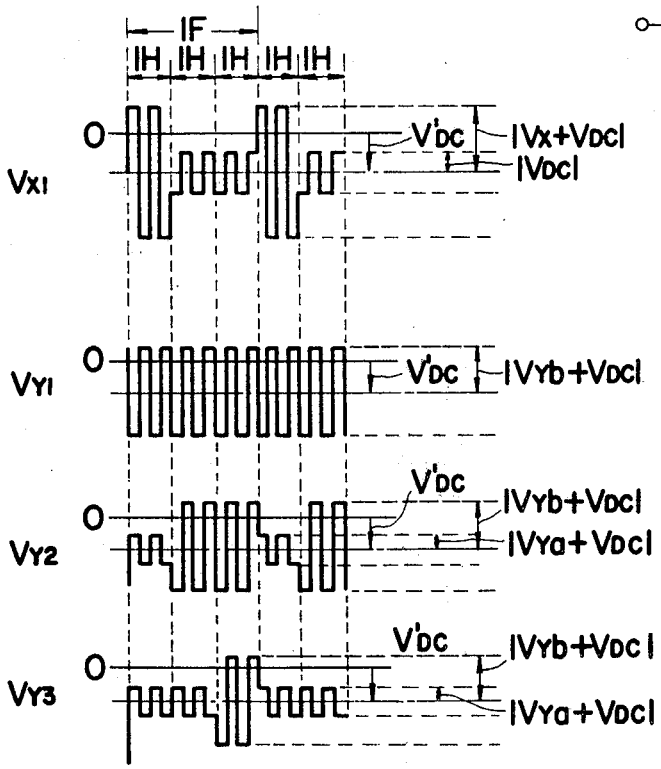
Figure 20:
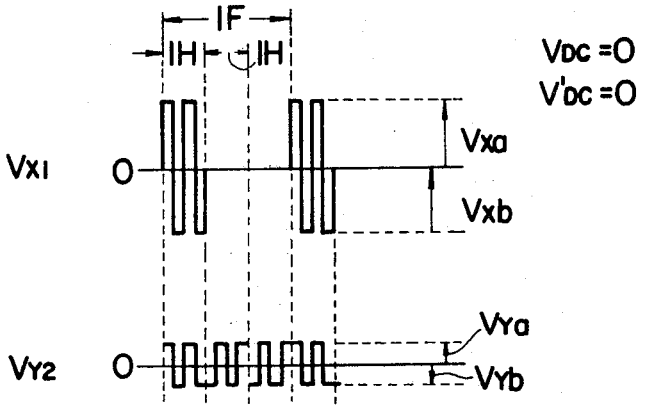

FIG. 19 shows an example of various waveforms of the A.C. drive in which a plurality of polarity inversions are performed within 1 H. In the figure, $V'_{DC}$ can take an arbitrary value. The waveform illustrated in the figure, however, is relatively complicated and is not practical. Therefore, $V_{DC}$ in the figure is made approximately zero, that is, the A.C. amplitude to be impressed during the nonaddress period of the X-lines is made approximately zero. Thus, the application waveform is simplified as shown in FIG. 20. Although the A.C. amplitude in the nonaddress period of the X-lines should desirably be zero, it may be below 10% of the A.C. amplitude in the address period of the X-lines.

Figure 21:
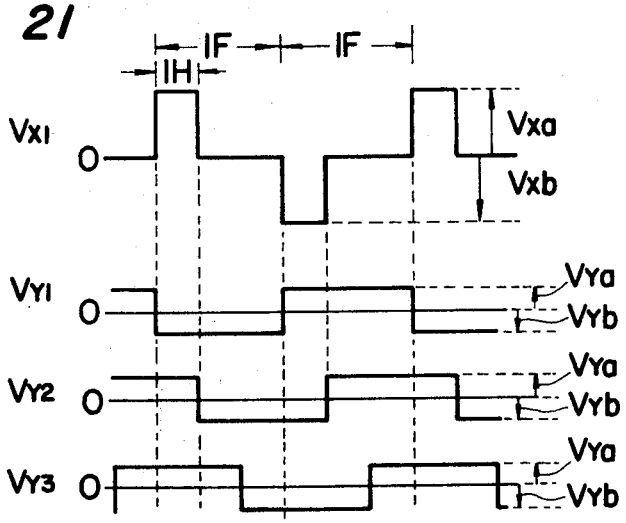

A waveform in the case where the period of the polarity inversions is 1 F and where $V_{DC} \doteq V'_{DC} \doteq 0$, is shown in FIG. 21. In FIGS. 20 and 21, $V_{Xa}$ and $-V_{Xb}$, and $V_{Ya}$ and $-V_{Yb}$ should desirably be equal to each other, but they may satisfy the following ranges:

$$\frac{\left| |V_{Ya}| - \frac{|V_{Ya} - V_{Yb}|}{2} \right|}{\left| \frac{V_{Ya} - V_{Yb}}{2} \right|} \leq 0.1 \qquad (8)$$

$$\frac{\left| |V_{Yb}| - \frac{|V_{Ya} - V_{Yb}|}{2} \right|}{\left| \frac{V_{Ya} - V_{Yb}}{2} \right|} \leq 0.1 \qquad (9)$$

$$\frac{\left| |V_{Xa}| - \frac{|V_{Xa} - V_{Xb}|}{2} \right|}{\left| \frac{V_{Xa} - V_{Xb}}{2} \right|} \leq 0.1 \qquad (10)$$

$$\frac{\left| |V_{Xb}| - \frac{|V_{Xa} - V_{Xb}|}{2} \right|}{\left| \frac{V_{Xa} - V_{Xb}}{2} \right|} \leq 0.1 \qquad (11)$$

As in the case of D.C., the relation between $V_{Xa}$, $V_{Xb}$ and $V_{Ya}$, $V_{Yb}$ may fulfill the following value:

$$\left| \frac{V_{Xa} - V_{Xb}}{V_{Ya} - V_{Yb}} \right| > 2 \qquad (12)$$

Figure 22:
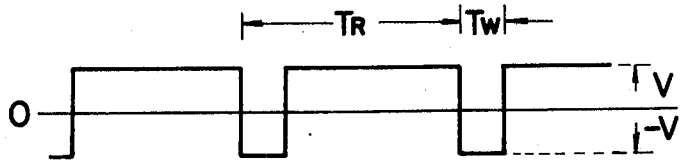
FIG. 22 is a waveform diagram of an applied voltage.
Figure 23:
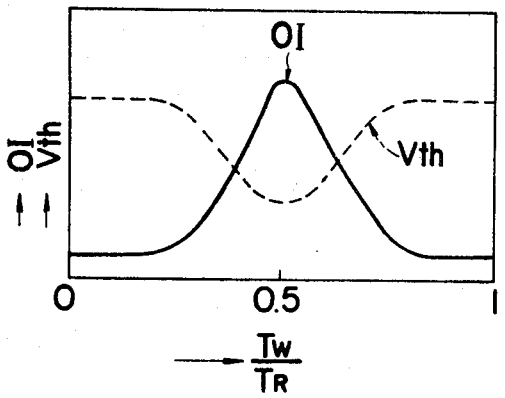
FIG. 23 is a characteristic diagram of a liquid crystal.

A waveform shown in FIG. 22, in which the absolute values of the positive and negative applied voltages are equal, the negative polarity period of time is $T_W$ and the recurrence period is $T_R$, is applied to a liquid crystal cell. As to this case, FIG. 23 illustrates the output intensity OI (the luminous intensity at the time when the liquid crystal cell is illuminated by a light source) at the time when the absolute values of the applied voltages are constant, and the relationship between the threshold voltage $V_{th}$ and $T_W/T_R$ at the time when the output intensity OI is constant. In FIG. 23 a solid line indicates the output intensity OI, and a dotted line the threshold voltage $V_{th}$. Here, at $T_W/T_R = 0.5$, the D.C. component becomes zero. As illustrated in the figure, even when the absolute values of the applied voltages are constant, changes of characteristics are caused by the D.C. component contained. It will now be described that the same changes of characteristics arise when the waveform in FIG. 10 is employed.

Figure 24:
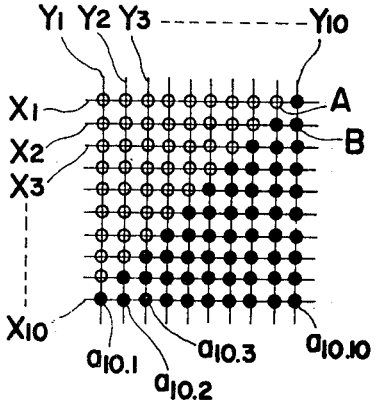
FIG. 24 is an explanatory diagram of a display picture.

In the description of this phenomenon, reference is had to FIG. 24. The figure illustrates by way of example a case where a matrix panel whose Y-lines consist of $Y_1$, $Y_2$, $Y_3$ . . . . and $Y_{10}$ and whose X-lines consist of $X_1$, $X_2$, $X_3$ . . . . and $X_{10}$ is so driven that the numbers of lit display cells represented by white circles A and non-lit display cells represented by black circles B differ for all the Y-lines. With note taken of the display cells $a_{10,1}$, $a_{10,2}$, $a_{10,3}$ . . . . and $a_{10,10}$ at the intersection points between the line $X_{10}$ and the respective Y-lines, the relationship between the applied voltage waveform and the intensity level at this time will be explained.

Figure 25:
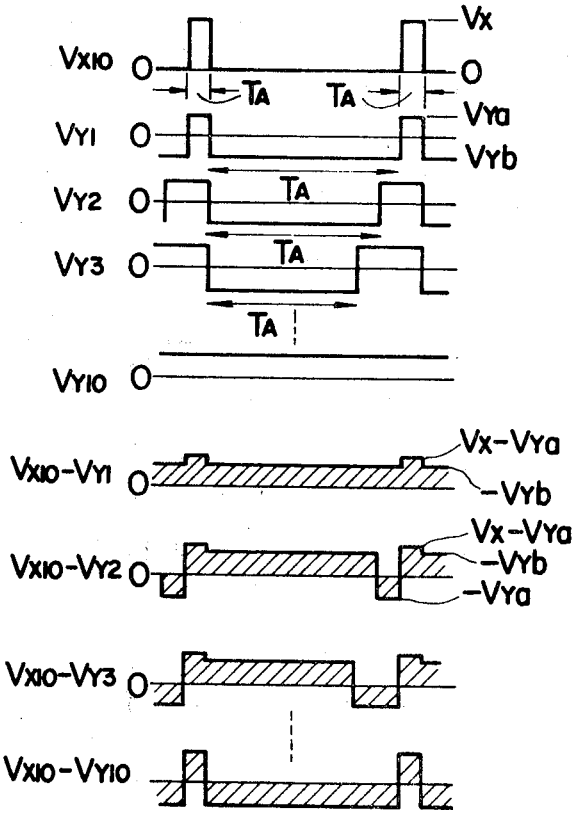
FIG. 25 is a waveform diagram of drive voltages.

FIG. 25 shows voltage waveforms which are applied to $X_{10}$ and $Y_1$, $Y_2$, $Y_3$ . . . . and $Y_{10}$, and voltage waveforms $V_{X10} - V_{Y1}$, $V_{X10} - V_{Y2}$, $V_{X10} - V_{Y3}$ . . . . and $V_{X10} - V_{Y10}$ which are applied to the respective display cells. In the figure, $T_A$ indicates the address period of each electrode, $V_X$ the voltage of the address period of the X-line, $V_{Ya}$ the voltage of the nonaddress period of the Y-line, and $V_{Yb}$ the voltage of the address period of the Y-line. In this case, the rate of the negative polarity of the voltages $V_{X10}$ $V_{Y1}$, $V_{X10} - V_{Y2}$, $V_{X10} - V_{Y3}$ . . . . and $V_{X10} - V_{Y10}$ applied to the respective display cells changes largely from 0 to nearly 90% in dependence on a picture to-be-displayed as understood from the ratio of the areas of parts indicated by oblique lines above and below a base line in the figure.

As stated with reference to FIG. 23, even when the absolute values of the applied voltages are equal, the characteristics of the liquid crystal cells change in dependence on the rate of the D.C. component. In this manner, with the waveform in FIG. 10, the rate of the D.C. component changes in dependence on the picture to-be-displayed and accordingly the characteristics of the respective liquid crystal cells change, so that a satisfactory picture display is difficult.

In order to solve this problem, the rate of the D.C. component may be prevented from changing in dependence on the picture to-be-displayed. The prevention is accomplished by keeping the D.C. component zero or in the vicinity thereof. To this end, the foregoing A.C. drive may be carried out. In the previously-stated case of the character display by the liquid crystal (10 × 50 picture elements, the transmission type, the dynamic scattering mode), the contrast ratio was improved from 12 : 1 (the drive system of applying the D.C. bias as illustrated in FIG. 10) to 20 : 1 (the A.C. drive system) by performing the A.C. drive. In addition, the liquid crystal cells can be made to have a long life by the A.C. drive.

As described above, by applying the present invention, the change of the picture quality dependent upon the input pictures is reduced, and the electric quantity to be applied to the address display cell increases, so that pictures of good contrast can be acquired. The invention is greatly effective as the display panel driving system.

What is claimed is:

1. In a line progressive scanning and driving method including the step of applying line progressive scanning-electric quantities to respective ones of a first group of electrodes of a display panel which is constructed such that a plurality of display cells each having substantially symmetrical optical characteristics for positive and negative input electrical quantities are arrayed in the form of a matrix, and the step of applying electrical quantities, corresponding to an information to-be-displayed, to respective ones of a second group of electrodes of said display panel, the improvement comprising the steps of adjusting the levels of said electrical quantities in an address period and in a nonaddress period as applied to said respective ones of said second group of electrodes to be substantially symmetrical to levels of said electrical quantities in a nonaddress period as applied to said respective ones of said first group of electrodes, the difference between said levels in said address period and in said nonaddress period, of said electrical quantities applied to said respective ones of said first group of electrodes being at least twice as large as the difference between said levels in said address period and in said nonaddress period, of said electrical quantities applied to said respective ones of said second group of electrodes.

2. The display panel driving method according to claim 1, characterized in that a reference level of said electrical quantities applied to said first group of electrodes and a reference level of said electrical quantities applied to said second group of electrodes are set so as to differ from each other.

3. The display panel driving method according to claim 1, further including the step of subjecting said electrical quantities applied to said first and second groups of electrodes to pulse width modulation, thereby to display at least three states.

4. The display panel driving method according to claim 1, characterized in that a plurality of fields constitute one time frame and that addressing is made at every predetermined field within said plurality of fields, and including the step of displaying at least three states.

5. The display panel driving method according to claim 1, characterized in that polarities of said electrical quantities applied to the respective display cells are periodically inverted.

6. The display panel driving method according to claim 5, characterized in that said electrical quantities applied to the scanning electrodes have an approximately zero A.C. amplitude during said nonaddress period.

* * * * *